US006167581B1

(12) United States Patent
Finn

(10) Patent No.: US 6,167,581 B1
(45) Date of Patent: Jan. 2, 2001

(54) PLIERS-BASED, COMBINATION TOOL

(76) Inventor: Patrick W. Finn, 1509 Crab Tree Dr., Westmont, IL (US) 60559

( * ) Notice: Under 35 U.S.C. 154(b), the term of this patent shall be extended for 0 days.

(21) Appl. No.: 09/196,377

(22) Filed: Nov. 19, 1998

Related U.S. Application Data

(63) Continuation-in-part of application No. 08/881,949, filed on Jun. 25, 1997, now Pat. No. 5,910,174.

(51) Int. Cl.[7] ..... B25B 7/22
(52) U.S. Cl. ..... 7/129; 81/416; 81/412
(58) Field of Search ..... 7/127, 131, 158, 7/129; 81/409, 412, 416, 9.4; 30/194, 173, 90.1, 91.2

(56) References Cited

U.S. PATENT DOCUMENTS

| | | | | |
|---|---|---|---|---|
| 753,048 | * | 2/1904 | Des Moineaux | 7/131 |
| 928,849 | * | 7/1909 | Carlson | 7/131 |
| 2,787,925 | * | 4/1957 | Buchanan et al. | 7/131 |
| 2,925,652 | * | 2/1960 | Lundquist . | |
| 3,860,981 | * | 1/1975 | Mayer | 30/90.1 |
| 4,987,626 | * | 1/1991 | Montgomery et al. | 7/127 |

* cited by examiner

*Primary Examiner*—David A. Scherbel
*Assistant Examiner*—Joni B. Danganan
(74) *Attorney, Agent, or Firm*—Mathew R. P. Perrone, Jr.

(57) ABSTRACT

The pliers have an elongated slot for the purpose of locking the shanks apart in order to permit the other tools on the pliers based combination tool to be used or an enhanced wire cutting slot.

15 Claims, 3 Drawing Sheets

FIG. 1
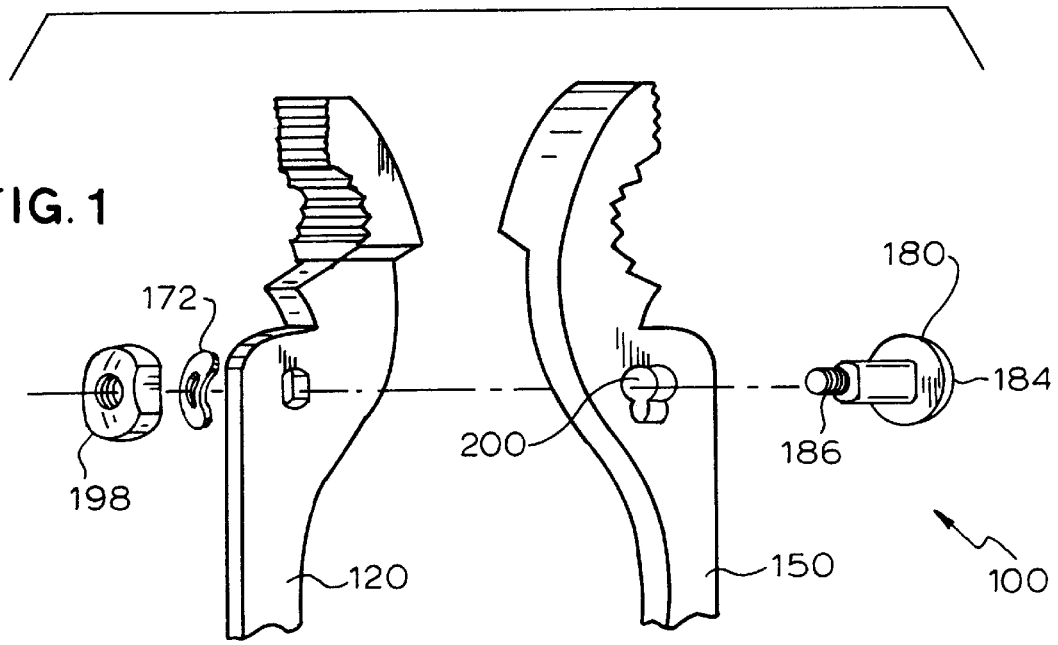
FIG. 2
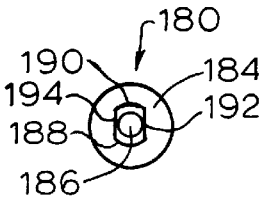
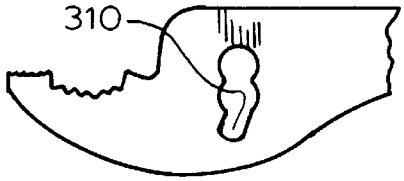
FIG. 4B
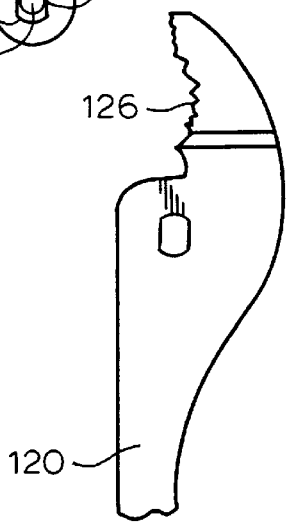
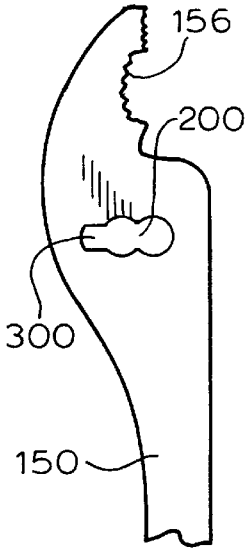
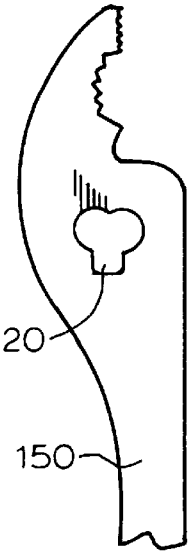
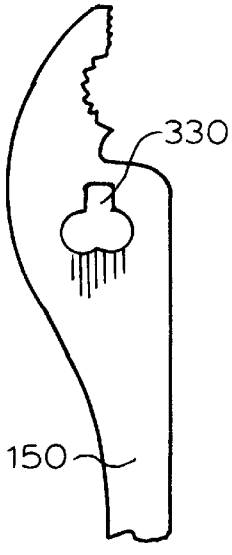
FIG. 3 FIG. 4A FIG. 5 FIG. 6

FIG. 7
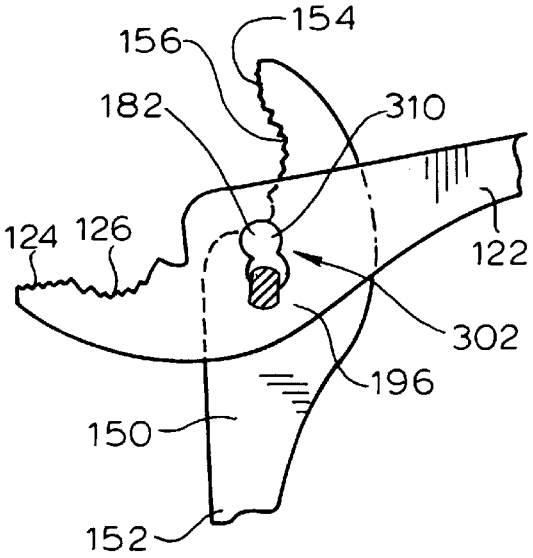
FIG. 8
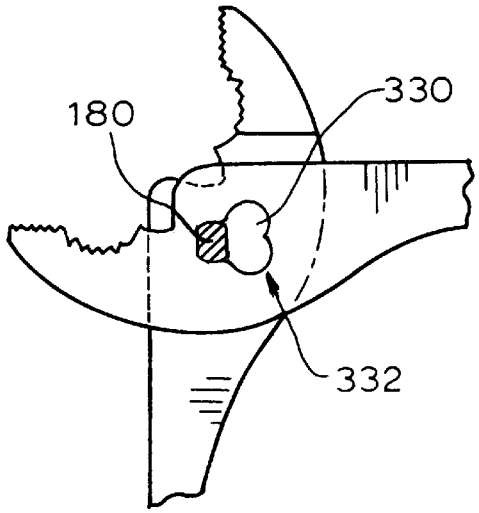
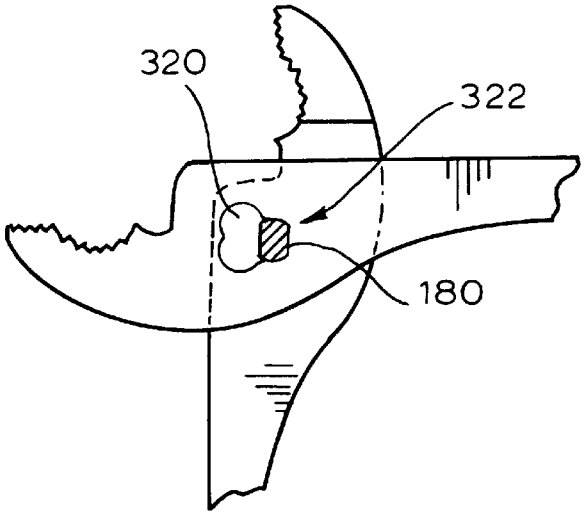
FIG. 9
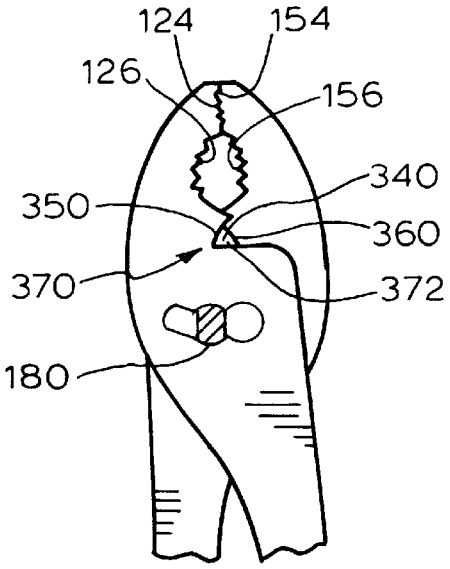
FIG. 10

PLIERS-BASED, COMBINATION TOOL

CROSS-REFERENCE TO RELATED APPLICATION

This application is a continuation in part of U.S. Pat. Ser. No. 08/881,949, filed Jun. 25, 1997; now U.S. Pat. No. 5,910,174; filed by the same inventive entity.

This invention relates to a combination tool based on a pliers and more particularly to pliers-based, combination tool, which can be easily locked in a position to use one of the other tools in the combination tool.

BACKGROUND OF THE INVENTION

Pliers generally have two arm elements pivotally connected at a slip joint. Each arm element has a handle at one end and a jaw at the other end. The slip joint serves to expand or contract the size of the jaw opening and the resultant gripping capability of the pliers as required. Two types of pliers are typical, being commonly referred to as crescent pliers or slip joint pliers.

It is highly desirable to provide combination tools. However, use of combination tools can result in a complicated set up, which destroys the efficiency of the tool involved. Also, it is highly desirable for a compound tool to be easily used with other components and easily transferred from the use of one element of the compound tool to another element, while at the same retaining the effectiveness of the individual tool.

Furthermore, there is great difficulty in having the elements locked into position for efficient use of each element of the compound tool. If the locking cannot be accomplished efficiently, the tool lacks the required effectiveness.

The locking device of the prior art are cumbersome. There is often difficulty in operating the locking device while in the act of using the pliers as a screwdriver or other tool. Both U.S. Pat. Nos. 4,920,593; and 5,119,520, by the same inventor, address these issues and are incorporated herein by reference. For that reason, further discussion of prior art locking mechanisms is not required.

If these factors can be accomplished efficiently, the advantages of having a compound tool are equivalent to providing each tool individually while retaining the advantages of having more than one tool available immediately.

If the pliers can be locked in a variety positions, the adaptability of the pliers becomes greater. This requires an adaptable pliers locking mechanism. Such an adaptability for the pliers locking mechanism is difficult to obtain.

While it is sometimes necessary to use the standard pliers as wire cutters, it is difficult to do so. There is no feature on existing pliers to greatly enhance the wire cutting capabilities of the pliers. If such an enhancement can be efficiently added, without complicating the manufacture of the pliers, great advantages can be obtained.

Also desirable is to have a multi-faceted pair of pliers. If the pliers tool can conserve the pliers function, while, at the same time, being modifiable in a simple fashion for other types of tools, greater advantages are obtained for the field of combination hand tools.

SUMMARY OF THE INVENTION

Therefore, among the many objectives of this invention is to provide a pliers combination tool, which is easily adapted to support the use of an additional tool, with the addition of a wire cutting capability.

A further objective of this invention is to provide a pliers combination tool, which is adapted to a side lock position.

A still further objective of this invention is to provide a pliers-based, combination tool adaptable to lock with one hand for using another tool.

Yet a further objective of this invention is to provide a pliers-based, combination tool adaptable with a phillips screw driver tip.

Also an objective of this invention is to provide a pliers-based, combination tool adaptable with a flat or blade screw driver tip.

Another objective of this invention is to provide a pliers-based, combination tool adaptable with a star screw driver tip.

Yet another objective of this invention is to provide a pliers-based, combination tool adaptable with an allen wrench tip.

Still another objective of this invention is to provide a pliers-based, combination tool adaptable with a scribe tip.

A further objective of this invention is to provide a pliers-based, combination tool adaptable with a square tip.

A still further objective of this invention is to provide a pliers-based, combination tool adaptable with a socket drive tip.

These and other objectives of the invention (which other objectives become clear by consideration of the specification, claims and drawings as a whole) are met by providing a pliers-based, combination tool; wherein the pliers have an elongated slot for the purpose of locking the shanks apart in order to permit the other tools to be used or an enhanced wire cutting slot.

BRIEF DESCRIPTION OF DRAWINGS

FIG. 1 depicts an exploded, perspective view of the pliers-based, combination tool 100 of this invention.

FIG. 2 depicts an end view of fulcrum bolt 180 for the pliers-based, combination tool 100 of this invention.

FIG. 3 depicts a side view of first jaw shank 126 and first pliers shank 120 for the pliers-based, combination tool 100 of this invention.

FIG. 4*a* depicts a side view of second jaw shank 156 and second pliers shank 150 for the pliers-based, combination tool 100 of this invention with straight end locking slot 300.

FIG. 4*b* depicts a side view of second jaw shank 156 and second pliers shank 150 for the pliers-based, combination tool 100 of this invention with angled end locking slot 310.

FIG. 5 depicts a side view of second jaw shank 156 and second pliers shank 150 for the pliers-based, combination tool 100 of this invention with bottom locking slot 320.

FIG. 6 depicts a side view of second jaw shank 156 and second pliers shank 150 for the pliers-based, combination tool 100 of this invention with top locking slot 330.

FIG. 7 depicts a side view of second jaw shank 156 and second pliers shank 150 for the pliers-based, combination tool 100 of this invention with end locking slot 300 having first jaw shank 126 and first pliers shank 120 in end lock position 302.

FIG. 8 depicts a side view of second jaw shank 156 and second pliers shank 150 for the pliers-based, combination tool 100 of this invention with top locking slot 330 having first jaw shank 126 and first pliers shank 120 in top lock position 332.

FIG. 9 depicts a side view of second jaw shank 156 and second pliers shank 150 for the pliers-based, combination tool 100 of this invention with bottom locking slot 320 having first jaw shank 126 and first pliers shank 120 in bottom lock position 322.

FIG. 10 depicts a side view of the pliers-based, combination tool 100 showing the enhanced wire cutting slot 340 of this invention.

Throughout the figures of the drawings, where the same part appears in more than one figure of the drawings, the same number is applied thereto.

DESCRIPTION OF THE PREFERRED EMBODIMENTS

Figure 11:
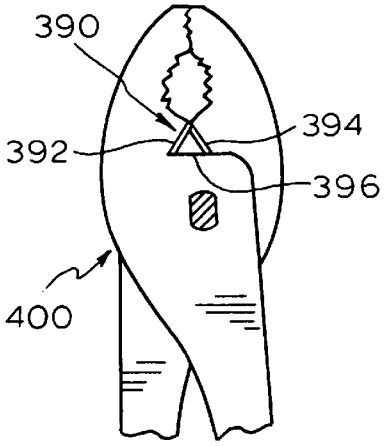
FIG. 11 depicts a closed side view of the pliers-based, combination tool 100 showing the enhanced wire cutting slot 340 with a first triangle 396 of this invention.

The pliers-base combination tool includes a standard pliers with a pair of jaws controlled by a pair of hand grips. A jaw shank connects the jaw to the handgrip. The first jaw is secured to the second jaw by a fulcrum bolt and a control slot. In this particular invention, the fulcrum bolt is modified to include a locking face. The jaw fulcrum is expanded to include a fulcrum cradle (also called a fulcrum slot) to receive the fulcrum bolt at the locking face. In this fashion, the handles can be removably locked in a separated manner.

The fulcrum cradle or fulcrum slot has two flat sides connected to a flat end by opposing arced connectors. This structure cooperates with the fulcrum bolt to removably lock the pliers as desired. With the design of the fulcrum cradle, three different positions for a locking slot are available. Firstly, the fulcrum cradle can be a top cradle, centrally situated on a top portion of the control slot. Secondly, the fulcrum cradle can be a bottom cradle, centrally situated on a bottom portion of the control slot. Each of the top cradle and the bottom cradle cooperates with the fulcrum bolt to lock the pliers combination in a desired position for as long as desired.

Additionally another position is permitted for the fulcrum cradle. The fulcrum cradle with locking slot can be an end cradle, preferably situated on an outer end of the control slot. The axis of the end cradle be the same as the control slot, or on an angle therewith.

The fulcrum cradle with locking slot as an end cradle has its central axis customarily at an acute angle relative to the central axis of the fulcrum cradle. Preferably, that acute angle is up to about forty five (45°) degrees. More preferably, that acute angle is about two (2°) degrees to about forty (40°) degrees. Most preferably, that acute angle is about three (3°) degrees to about thirty (30°) degrees.

Furthermore, locking slot for the fulcrum cradle can be a bottom cradle, centrally situated on a bottom portion of the fulcrum cradle. Additionally, the locking slot for the fulcrum cradle can be a top cradle, centrally situated on a top portion of the fulcrum cradle. Most preferably, the central axis for top cradle or bottom cradle both substantially bisects and is at a right angle to the central axis of the fulcrum cradle.

The fulcrum bolt connects first jaw shank to second jaw shank and thence first arm to second arm. The fulcrum bolt includes a head and a threaded portion oppositely disposed therefrom. Between the head and the threaded portion is the slide member. The slide member fits into the jaw fulcrum at fulcrum cradle until the head contacts the first jaw shank and is positioned thereby. Part of the slide member fits into the fulcrum bolt grip hole, in order to prevent the rotation of the bolt, while permitting the first jaw shank and the second jaw shank to move relative to each other. The threaded bolt fits into the grip hole and held in position by the fulcrum lock nut.

The slide member permits the first jaw to rotate freely between the second jaw and the travel stop on the jaw. The slide member has a pair of opposing flattened sides. The slide member rotates about the fulcrum cradle. The opposing flattened sides fit into lock cradle, thereby removably locking the handles apart for use of the additional tools. The arced sides of the slide member fit one at a time into the end of lock cradle, depending on which locked position is used. With structure it is even possible to achieve the locking of the handles of the pliers with a flip of the wrist.

The first jaw and the second jaw include opposing angled members, which combine to form a triangulated shape. These opposing angled members are positioned adjacent to fulcrum bolt and below the gripping jaw. The triangulated shape is adapted to receive a wire. With the resulting triangular shape as the jaws are in contact, a substantially more efficient wire cutter is provided on the pliers due to the arcs and the resulting triangle.

These are additional tools for use with and on a pair of pliers. A typical pliers has a figure eight rounded slot or fulcrum cradle is in the center. This permits the pliers to slide from one slot to the other depending on how wide a grip is needed with the pliers. This particular pliers has an additional slot at the end, top or bottom of a loop of the figure eight.

Into this slot can fit the rivet holding the two pliers jaws together. The rivet is flattened on two sides to permit locking of the two flat sides in the custom-fitting slot. Such locking puts the handles of the plier at right angles to each other and permits a variety of implements to be used on the pliers shanks. The implements can be a screwdriver of any style or a socket receiver. Additionally, caps can be placed over the end of the screwdriver. These caps may be screwed on or otherwise attached. A preferred attachment means is where the cap slide on and are twisted 90 degrees to provided locking slots to hold the caps in place. Such implements are described in the parent application.

An especially effective use of this pliers is called the triangle portion below the gripping jaw. The angles provided therein contrast to the standard straight pliers and provide an additional cutting force, which permits the pliers to cut wire more efficiently. Thus, as the pliers are squeezed together, the resultant triangular portion from the two angled portions apply greater pressure to the wire and permit the wire to be cut in a more efficient manner.

The locking slot at either end or the top or bottom of the slide mechanism of the pliers permits a more efficient locking. The shape of the bolt and the positioning thereof permits this locking to be accomplished in a very efficient fashion and permits the pliers to be used efficiently.

In order to improve wire cutting capabilities for the pliers, an enhanced wire cutting slot is desired. The enhanced wire cutting slot is positioned below both first jaw shank and second jaw shank, and adjacent to the fulcrum bolt. Enhanced wire cutting slot includes a first angled member adjacent first jaw and second angled member.

The angled members form a triangulated shape, when first jaw contacts second jaw. Triangulated shape has the general form of a triangle, with slightly arcuate sides. Such a structure permits a wire to be inserted therein with first jaw spaced apart from second jaw.

A sloped triangulated shape can also be formed. If two sides are formed in sloped fashion, the triangle on one side of the pliers has a different perimeter and size than the triangle on the other side of the pliers.

An enhanced wire severing edge can be provided by forming or machining half of the triangle on opposing sides of the pliers. The enhanced wire severing edge thus has opposing sides thereof on opposing sides of the pliers, such that only one part thereof may be seen, when viewing each side. This reverse structure places two sharper edges against a wire desired to be cut and permits a more efficient cutting.

Referring now to FIG. 1 and FIG. 2, a first pliers shank 120 may be connected to second pliers shank 150. The first pliers shank 120 is secured to the second pliers shank 150 by a fulcrum bolt 180 through an expanded jaw fulcrum 200.

First pliers shank 120 includes a first hand grip 122 (partially shown) and a first jaw 124 with a first jaw shank 126 therebetween. In the first jaw shank 126 is the expanded jaw fulcrum 182. The second pliers shank 150 includes a second hand grip 152 (partially shown) and a second jaw 154 with a second jaw shank 156 therebetween. In the second jaw shank 156 is the fulcrum bolt aperture 196.

Expanded jaw fulcrum 200 receives fulcrum bolt 180. Fulcrum bolt 180 has a head 184 and a threaded portion 186 oppositely disposed from the head 184. Between the head 184 and the threaded portion 186 is slide member 188. Slide member 188 has a two rounded ends connecting a first flat side 192 and a second flat side 194. Threaded portion 186 receives fulcrum nut 198. Slide member 188 fits into jaw fulcrum 200.

If desired, bent washer 172 can slide over threaded portion 186. Bent washer 172 is thus between fulcrum nut 198 and between second jaw shank 156, while being adjacent to fulcrum bolt aperture 196. Bent washer 172 removes some of the play between first jaw shank 136 and second jaw shank 156. If such is desired, bent washer 172 is used. If such is not required, bent washer 172 is not used. Bent washer 172 is adapted to fit over threaded portion 186, while being arcuate from an edge or side view, to relieve the play between the jaws.

Adding FIG. 3, FIG. 4*a* and FIG. 4*b*, and FIG. 7 to the consideration, the straight end locking slot 300 is depicted. Fulcrum bolt 180 fits into straight end locking slot 300 (FIG. 4*a*) at slide member 188 to show end lock position 302 of straight end locking slot 300. Fulcrum bolt 180 also fits into angled end locking slot 310 (FIG. 4*b*) at slide member 188 to show end lock position 302 for angled end locking slot 300. The straight end locking slot 300 and the angled end locking slot 310, both permit a greatly simplified switch into and out of end lock position 302.

Adding FIG. 3, FIG. 5 and FIG. 9 to the consideration, the top locking slot 330 is depicted. Fulcrum bolt 180 fits into top locking slot 330 at slide member 188 to top lock position 332. Like end locking slot 300, the nature of top locking slot 330, permits a greatly simplified switch into and out of end lock position 302.

Adding FIG. 3, FIG. 6 and FIG. 8 to the consideration, the bottom locking slot 320 is depicted. Fulcrum bolt 180 fits into bottom locking slot 320 at slide member 188 to bottom lock position 322. Like end locking slot 300 and top locking slot 320, the nature of bottom locking slot 320, permits a greatly simplified switch into and out of bottom lock position 302.

Referring now to FIG. 10, below first jaw shank 126 and second jaw shank 156, and adjacent to the fulcrum bolt 180 is a enhanced wire cutting slot 340. Enhanced wire cutting slot 340 includes a first angled member 350 and second angled member 360.

Below first jaw shank 126 and adjacent to the fulcrum bolt 180 is a first angled member 350 of the enhanced wire cutting slot 340. Also, below second jaw shank 156 and adjacent to the fulcrum bolt 180 is a second angled member 360 of the enhanced wire cutting slot. First angled member 350 and second angled member 360 combine to form a triangulated shape 370, when first jaw 124 contacts second jaw 154, as shown in FIG. 10.

Triangulated shape 370 has the general form of a triangle, with slightly arcuate sides 372. Such a structure permits a wire (not shown) to be inserted therein with first jaw 124 spaced apart from second jaw 154. First jaw 124 can then brought in contact. Arcuate sides 372, permit the wire to be broken in much more efficient fashion than standard pliers, without such triangulation (shown in FIG. 7, which may be easily modified to include the triangulation).

Figure 12:
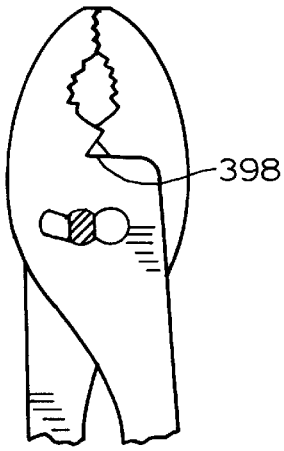
FIG. 12 depicts a side view of the pliers-based, combination tool 100 showing the enhanced wire cutting slot 340 with a second triangle 398 of this invention, which is a reverse view of FIG. 11.

Now considering FIG. 11 and FIG. 12, sloped triangulated shape 390 is depicted, with pliers based combination tool 100 in closed position 400. Sloped side 392 and sloped side 394 combine to form different sized triangles. Thus a first triangle 396 is formed as pliers such pliers based combination tool 100 are viewed from one side, while second triangle 398 is formed from the other side. The sloping makes first triangle 396 have a larger perimeter than second triangle 398. This makes the pliers based combination tool 100 a more efficient wire cutter.

Figure 13:
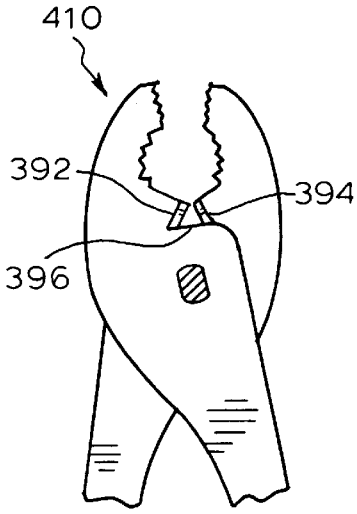
FIG. 13 depicts a open side view of the pliers-based, combination tool 100 showing the enhanced wire cutting slot 340 with a first triangle 396 of this invention, related to FIG. 11.
Figure 14:
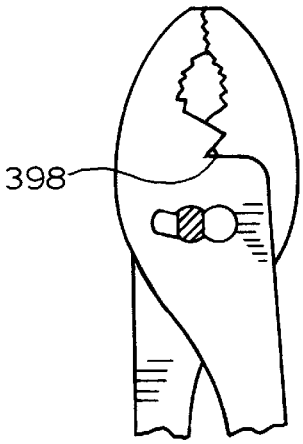
FIG. 14 depicts a side view of the pliers-based, combination tool 100 showing the enhanced wire cutting slot 340 with a second triangle 398 of this invention, related to FIG. 12.

Now considering FIG. 13 and FIG. 14, sloped triangulated shape 390 is depicted, with pliers based combination tool 100 open position 410. Sloped side 392 and sloped side 394 are viewed more clearly. Thus, a first triangle 396 is formed as pliers are viewed from one side, while second triangle 398 is formed from the other side. The sloping makes first triangle 396 have a larger perimeter than second triangle 398. This makes the pliers based combination tool 100 a more efficient wire cutter.

Figure 15:
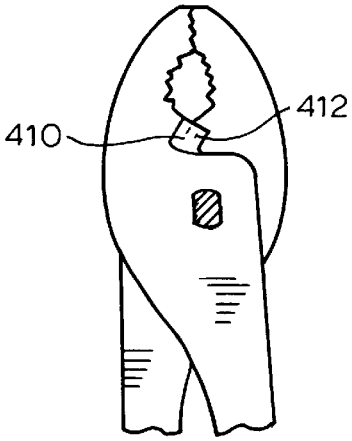
FIG. 15 depicts a rear side view of the pliers-based, combination tool 100 showing the enhanced wire severing edge 410.
Figure 16:
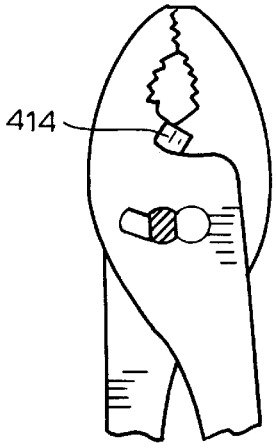
FIG. 16 depicts a front side view of the pliers-based, combination tool 100 showing the enhanced wire severing edge 410, which is a reverse view of FIG. 15.

With FIG. 15 and FIG. 16, the enhanced wire severing edge 410 is depicted as a preferred alternate for enhanced wire cutting slot 340 of FIG. 10. Enhanced wire cutting edge 410 differs from that shown in FIG. 13 and FIG. 14 in that the first enhanced edge 412 (FIG. 15) is on opposing side of combination tool 100, relative to second enhanced edge 414 (FIG. 16). This reverse structure places two sharper edges in the form of first enhanced edge 412 and second enhanced edge 414 against a wire (not shown) desired to be cut and permits a more efficient cutting.

This application—taken as a whole with the abstract, specification, claims, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this tool can become clear to a person having ordinary skill in this particular art. Such modifications are clearly covered by this disclosure.

What is claimed and sought to be protected by Letters Patent is:

1. A pliers-based, combination tool having a first shank and a second shank, wherein the pliers have a means for locking the first shank and the second shank apart, the means for locking comprising:

(a) a fulcrum cradle cooperating with a fulcrum bolt;

(b) a locking slot extending from the fulcrum cradle;

(c) the locking slot being adapted to receive the fulcrum bolt in order to lock the pliers in a desired position; and (d) the locking slot extending at an acute angle, relative to a central axis of the fulcrum cradle, from an outer end of the fulcrum cradle.

2. The pliers-based, combination tool of claim 1 further comprising:

(a) the fulcrum bolt including a head and a threaded portion oppositely disposed from the head;

(b) a slide member on the fulcrum bolt being situated between the head and the threaded portion; and (c) the slide member being adapted to fit into the locking slot.

3. The pliers-based, combination tool of claims 2 further comprising:

(a) the slide member including a first arcuate side and a second arcuate side, and the slide member including a first flat side and a second flat side;

(b) the first arcuate side being oppositely disposed from the second arcuate side; and (c) the first flat side being oppositely disposed from the second flat side.

4. The pliers-based, combination tool of claim 3 further comprising the acute angle being up to about forty five (45°) degrees.

5. In a pliers-based, combination tool having a gripping jaw and fulcrum slot, wherein the pliers-based, combination tool has a means for cutting wire, the means for cutting wire further comprising:

(a) the means for cutting wire including a triangle portion between the gripping jaw and the fulcrum slot;

(b) the triangle portion including a first angle member side and a second angle member side;

(c) the triangle portion being formed by the first angle member side and the second angle member side;

(d) the pliers based combination tool having a first pliers side and a second pliers side; and (e) the triangle portion having a different perimeter when comparing the first pliers side with the second pliers side.

6. The pliers-based, combination tool of claim 5 further comprising the triangle portion being larger when viewed from the first pliers side than from the second pliers side.

7. In a pliers-based, combination tool having a first shank and second shank, a gripping jaw and a fulcrum slot, wherein the pliers-based, combination tool has a means for cutting wire and a means for locking the first shank and the second shank apart, the improvement comprising:

(a) the means for locking including a fulcrum cradle cooperating with a fulcrum bolt;

(b) a locking slot extending from the fulcrum cradle;

(c) the locking slot being adapted to receive the fulcrum bolt in order to lock the pliers in a desired position;

(d) the means for cutting wire including an open triangle portion between the gripping jaw and the fulcrum slot;

(e) the triangle portion including a first angle member side and a second angle member side;

(f) the triangle portion being formed by the first angle member side and the second angle member side;

(f) the first angle member side being situated on the first shank;

(g) the second angle member side being situated on the second shank;

(h) the triangle portion being formed by the first angle member side and the second angle member side;

(i) the pliers based combination tool having a first pliers side and a second pliers side; and (j) the triangle portion having a different perimeter when comparing the first pliers side with the second pliers side.

8. The pliers-based, combination tool of claim 7 further comprising the triangle portion being larger when viewed from the first pliers side than from the second pliers side.

9. The pliers-based, combination tool of claim 8 further comprising the locking slot extending at an angle from an end of the fulcrum cradle.

10. The pliers-based, combination tool of claim 8 further comprising the locking slot extending from a top portion of the fulcrum cradle.

11. The pliers-based, combination tool of claim 8 further comprising the locking slot extending from a bottom portion of the fulcrum cradle.

12. The pliers-based, combination tool of claim 8 further comprising:

(a) the fulcrum bolt including a head and a threaded portion oppositely disposed from the head;

(b) a slide member for the fulcrum bolt being situated between the head and the threaded portion;

(c) the slide member being adapted to fit into the locking slot; and (d) an arcuate side of the triangle portion being placed over the threaded portion.

13. The pliers-based, combination tool of claim 12 further comprising:

(a) the slide member including a first arcuate side and a second arcuate side, and the slide member including a first flat side and a second flat side;

(b) the first arcuate side being oppositely disposed from the second arcuate side; and (c) the first flat side being oppositely disposed from the second flat side.

14. The pliers-based, combination tool of claim 13 further comprising:

(a) the locking slot extending at an angle from an end of the fulcrum cradle; and (b) the angle is an acute angle is up to about forty five (45°) degrees.

15. The pliers-based, combination tool of claim 14 further comprising:

(a) the locking slot extending from a top portion of the fulcrum cradle; and (b) a central axis for the locking slot both substantially bisecting and being perpendicular to a central axis of the fulcrum cradle.

* * * * *